US005331250A

United States Patent [19]

Ravi et al.

[11] Patent Number: 5,331,250

[45] Date of Patent: Jul. 19, 1994

[54] THICK FILM RESISTOR FOR USE IN A VACUUM AND A HIGH PRESSURE DISCHARGE LAMP HAVING SUCH A RESISTOR

[75] Inventors: Jagannathan Ravi, Elmira, N.Y.; Gerard Van Bockstal, Lier, Belgium; Go Suzuki, Aichi; Kouji Shirasu, Yamanashi, both of Japan

[73] Assignees: North American Philips Corporation, New York, N.Y.; NGK Insulators, Ltd., Nagoya, Japan

[21] Appl. No.: 966,245

[22] Filed: Oct. 26, 1992

Related U.S. Application Data

[63] Continuation-in-part of Ser. No. 626,914, Dec. 12, 1990, Pat. No. 5,159,242.

[51] Int. Cl.[5] ..... H01J 7/44

[52] U.S. Cl. ..... 315/71; 315/46; 315/47; 315/50; 315/52; 315/58; 315/60; 315/73; 338/308

[58] Field of Search ..... 315/50, 52, 53, 59, 315/58, 60, 46, 47, 71, 73, 74, 75; 338/308; 313/25, 634, 570, 573, 15

[56] References Cited

U.S. PATENT DOCUMENTS 4,734,612 3/1988 Sasaki et al. ..... 313/15
5,159,242 10/1992 Ravi ..... 315/52

FOREIGN PATENT DOCUMENTS 0053401 4/1980 Japan ..... 338/308

*Primary Examiner*—James B. Mullins
*Assistant Examiner*—J. Dudek
*Attorney, Agent, or Firm*—Brian J. Wieghaus

[57] ABSTRACT

A high pressure discharge lamp having a thick film resistor comprising a plurality of resistive elements. A first resistive element is included in a starting circuit for the lamp and a second resistive element is in series with the arc tube during lamp operation for flicker elimination. The integral thick film resistor facilitates mounting and connection of the resistor elements within the lamp envelope. Favorably, the resistor substrate has a surface emissivity of greater than about 0.5, and preferably greater than about 0.9, to provide sufficient radiation cooling within an evacuated outer lamp envelope to prevent resistor failure while keeping the size of the resistor small enough for use as a component in an HID lamp. Additionally, a suitable coating of low vapor pressure thickness covers the solder connecting the metallic resistor terminals to the substrate to prevent evaporation of the solder and its deposition on the inner surface of the outer lamp envelope.

27 Claims, 3 Drawing Sheets

THICK FILM RESISTOR FOR USE IN A VACUUM AND A HIGH PRESSURE DISCHARGE LAMP HAVING SUCH A RESISTOR

CROSS-REFERENCE TO RELATED APPLICATIONS

This is a continuation-in-part of U.S. application Ser. No. 626,914 filed on Dec. 12, 1990, now U.S. Pat. No. 5,159,242 entitled "High Pressure Discharge Lamp Having An Integral Thick Film Resistor With Multiple Resistive Elements" of Jagannathan Ravi which discloses and claims an HID lamp having an integral thick-film resistor comprising a plurality of resistive elements. Also of interest is U.S. application Ser. No. 966,214, filed concurrently herewith, of J. Ravi and Gerard Luijks entitled "HID Lamp Having Overcurrent Fuse Protection" which discloses and claims an HID lamp having a ceramic thick film resistor which cracks at a preselected current level to fuse and disconnect the discharge vessel from its source of electric potential.

BACKGROUND OF THE INVENTION

1. Field of the Invention

The invention relates to high pressure discharge lamps, and more specifically, to high pressure discharge lamps having thick film resistors included within the outer lamp envelope. The invention also relates to an improved thick film resistor for operation in a vacuum, and especially in a high temperature vacuum, environment.

2. Description of the Prior Art

High pressure discharge lamps, including high pressure sodium vapor discharge (HPS) lamps, metal halide lamps, and mercury vapor lamps, often have multiple power-dissipating resistors included in the lamp circuit and within the outer lamp envelope. Power resistors are typically considered to be resistors which dissipate greater than about 1 watt during operation.

One or more resistors often form part of a starting circuit within the envelope for starting the discharge vessel, or arc tube. In metal halide lamps and mercury vapor lamps, the starting circuit typically includes an auxiliary electrode in the discharge vessel adjacent one of the discharge electrodes, which auxiliary electrode is electrically connected to the opposite discharge electrode through a current limiting resistor. Often a bimetal switch is in series with the current limiting resistor to remove the resistor and the auxiliary electrode after starting and stabilization of the discharge arc. A common starting circuit for HPS lamps includes a glow starter switch in series with a current limiting resistor and a bimetal, all of which are in parallel circuit with the arc tube. Resistors used in this type of HPS starting circuit typically have a resistance of over a hundred ohms and dissipate high power, on the order of several hundred watts. They are electrically disconnected from the arc tube circuit by the glow switch shortly after ignition of the discharge arc, typically within approximately 20 seconds after initial application of an electric current to the lamp. Several minutes after ignition of the discharge arc, the bimetal opens in response to heat from the discharge vessel to physically and electrically disconnect the glow switch and starting resistor from the arc tube circuit.

Additional resistors may be in the arc tube circuit during lamp operation to improve lamp performance. For example, U.S. Pat. No. 4,258,288 (Michael et al) discloses a metal halide high-intensity discharge (HID) lamp for connection to a constant wattage (CWA) ballast of the type having a transformer with a secondary winding in series with a capacitor. The lamp has an internal voltage-doubler starting circuit with two resistors in series with a bimetal switch. The bimetal switch disconnects the starting circuit and auxiliary electrode after starting of the lamp. The lamp also has a third power resistor in series with the arc tube which reduces the phase shift between the lamp voltage and the ballast open circuit voltage during lamp warm-up. The resistor increases the maximum sustaining voltage to the lamp when the lamp current is zero, thereby preventing flicker and extinguishment of the arc.

Japanese Kokai 1-211896 shows an unsaturated high pressure sodium discharge lamp suitable for operation on a CWA ballast. The lamp has a resistor in series with the arc tube to reduce the reignition voltage of the arc tube to prevent flicker of the arc, which otherwise occurs under certain operating conditions of the ballast and lamp. Because the resistor is in series with the arc tube, it operates continuously during lamp operation after ignition of the discharge arc and dissipates considerable power, approximately 15 watts for a 150 watt lamp.

Various types of power resistors have been used in high pressure discharge lamps, including filament resistors and miniature incandescent lamps. Filament resistors used in starting circuits have the disadvantage that they generally must be long, and as a result are formed into coils and/or suspended in zig-zag form, causing space and mounting problems within the lamp envelope. They are also sensitive to vibrations and mechanical shock, and consequently are a source of lamp failures. The use of miniature incandescent resistor lamps has typically been confined to continuous duty applications, such as the series flicker elimination resistor in unsaturated HPS lamps. Although the life of miniature lamps for this application must be longer than the life of the arc tube, typically greater than 24,000 hours, their filament is also subject to failure from shock and vibration and may be the cause of lamp failure.

Recently, ceramic thick film resistors, wherein a thick film resistive element such as tungsten is disposed on a ceramic substrate, have been used in starting circuits for HID lamps. For example, U.S. application Ser. No. 07/378,879 filed Jul. 12, 1989 shows a thick film resistor in a starting circuit for high pressure sodium discharge lamps. J.P. Kokai 56-73856 discloses a thick film resistor as a starting resistor for metal halide lamps and high pressure sodium discharge lamps. Thick film resistors are suitable for starting circuits because they reliably dissipate the required several hundred watts for the period just prior to lamp starting (≅20 sec) while having a long life.

However, the use of thick film resistors in HID lamps for continuous duty operation has not been evident. For example, J.P. Kokai 1-211896 shows a tungsten filament resistor for flicker elimination. The resistor is mounted to the lamp frame at the dome end of the outer envelope, which requires a complicated construction and causes shadowing of the light emitted from the lamp. Even where a thick film resistor has been employed in a starting circuit for very high power dissipation prior to starting, separate resistors have been used for lower power applications. For example, J.P. 56-73856 shows a conventional carbon resistor in series with the auxiliary electrode in addition to the thick film short-duty starting resistor.

Accordingly, prior HID lamps having multiple resistor means have employed separate resistor components for each resistor means and suffer from the complexity, cost, and reliability problems associated with handling, mounting, and connecting multiple resistor components to other elements within the lamp envelope. Additionally, although not discussed in J.P. Kokai 1-211896, CWA mercury ballasts do not have a starter. In unsaturated HPS lamps for operation on this type of ballast, it is desirable to include a starting circuit within the lamp envelope. However, mounting of the starting resistor, glow starter, and bimetal switch near the base end of the lamp envelope is space consuming and typically requires multiple welds to the lamp frame. Mounting of an additional flicker elimination resistor component on the lamp frame between the discharge vessel and the lamp stem has not been practicable. For mercury-retrofit HPS lamps, the light center length of the arc tube measured from the base should equal the light center length of the mercury vapor lamp which it replaces to obtain optimum optical performance in the luminaire. Thus, it is not feasible to position the arc tube further from the base to obtain more mounting space on the frame in such a lamp.

SUMMARY OF THE INVENTION

It is an object of the invention, in high pressure discharge lamps having multiple resistor means disposed within the lamp envelope, to eliminate the problems of handling, mounting, and connecting separate resistor components in the lamp envelope.

It is another object of the invention to reduce the cost and increase the reliability of HID lamps having multiple resistor means.

Yet another object of the invention is to simplify the construction of HID lamps having a starting circuit with a first resistor which dissipates very high power prior to lamp starting and a second resistor in series with an arc tube which continuously dissipates considerable power during lamp operation.

Still another object of the invention is to provide an improved ceramic thick film resistor for operation in a vacuum environment with long life, and especially for the high temperature vacuum environment within the outer envelope of an HID lamp such that resistor failure is not determinative of lamp life.

According to the invention, in a high pressure discharge lamp having a discharge vessel, or arc tube, and multiple resistor means arranged within an outer envelope, a thick film resistor having an integral substrate is provided which comprises a plurality of the resistor means. The lamp according to the invention has the advantage that the number of resistor components which must be mounted in the lamp is less than the number of resistor means required in the lamp. Preferably, the thick film resistor comprises all of the resistor means so that only one resistor component, the integral thick film resistor, needs to be mounted within the lamp envelope. In addition to simplifying the mount structure and increasing the ruggedness of the lamp, the use of one resistor component reduces the number of parts which must be handled during lamp assembly, reducing loss and breakage, and consequently lamp cost.

The resistor means included in the integral thick film resistor are comprised of corresponding metallic resistive elements, such as conventional metallic deposition patterns, all of which may be disposed on a single substrate. However, in a particularly advantageous embodiment, the thick film resistor comprises a plurality of integral substrate layers with the metallic resistive elements disposed between corresponding layers. This has the advantage that the length and width dimensions of the substrate may be minimized to the dimensions required by the metallic deposition pattern of the resistive element with the highest ohmic value. For example, the pattern for a resistive element may be disposed on a first substrate layer and the patterns for one or more elements of substantially less resistance may be arranged on a second substrate layer, or on the reverse side of the same substrate within the dimensions of the larger resistive pattern. Alternatively, each pattern may be disposed on a respective substrate layer.

The conventional materials used for thick film resistive elements, for example, tungsten, typically has a resistance which is temperature dependent and increases with increasing temperature. If included in an HID lamp on a separate substrate, a continuous duty resistive element having a resistance suitable for flicker elimination would take time to reach its designed operating resistance. This is a disadvantage because the optimum resistance required for flicker elimination would not be achieved until several minutes after initial flow of the arc tube current through the resistor.

The above problems are alleviated in another embodiment in which a high pressure discharge lamp has an integral thick film resistor comprising a first resistive element which dissipates power prior to ignition of the discharge arc and a second resistive element operative after ignition of the discharge arc. The first and second resistive elements are arranged on the substrate such that heat from the first resistive element during starting of the lamp raises the temperature of the second resistive element such that it reaches its designed steady-state resistance faster than if heated from the arc tube current alone. The heating of the second resistive element prior to arc ignition has the additional advantage of less thermal shock to that element upon flow of the arc current, and reduced chances of failure of the second resistive element, and the lamp, caused by the effects of thermal shock.

A desirable thick film resistor for obtaining optimum heating of the second resistive element while providing a practical construction consists of three integral insulative substrates, the first resistive element being disposed between a first and second of said substrates and the second resistive element being disposed between the second and a third of said substrates.

Thick-film resistors can be damaged if subject to excessive temperatures, 700° to 800° C., for example, even for a short period of time (=10 minutes) if conventional silver-copper solder is used for attachment of the resistor terminals to the ceramic substrate. This temperature could be reached in a standard starting circuit for an HPS lamp if the discharge vessel did not ignite within a predetermined time period, which would result in the first resistive element (starting resistor) not being disconnected by the glow switch or the series bimetal in response to heat from the discharge vessel. Protection from damaging temperatures may be possible with a substrate of sufficiently large area, however, this would result in an unwieldy resistor. Thus, according to another embodiment, means are provided for disconnecting the resistive element in response to heat from the thick film resistor to prevent damage from excess temperature. The means may be a second bimetal switch. However, a single bimetal is preferably arranged on the resistor, in series with the first resistive element, to disconnect the first resistive element in response to heat from the discharge vessel upon successful ignition of a discharge arc or, in the event of unsuccessful ignition of the discharge vessel, in response to heat from the resistor before the resistor reaches a damaging temperature.

According to another embodiment of the invention, the HID lamp is an unsaturated high pressure sodium discharge lamp having said integral thick film ceramic resistor with said first and second resistive elements. The first resistive element forms part of a starting circuit for the discharge vessel. The first resistive element is in series with a glow discharge starter and a normally closed bimetal element which opens in response to heat from the discharge vessel and/or the thick film resistor for removing the resistor and the glow starter from the lamp circuit either upon successful ignition of the discharge vessel or upon the resistor reaching its maximum safe temperature. The second resistive element is in series with the discharge vessel during lamp operation for eliminating flicker of the discharge arc when the lamp is operated on a constant wattage type ballast.

It has also been found that a thick film resistor having a conventional "white" alumina substrate, such as used in the above-mentioned J.P. Kokai 56-73856, is subject to damage during operation of the series-connected continuous duty resistive element by heat generated from this element and the heat from the discharge vessel. It was discovered that at an operating temperature of about 700° C. or greater the resistor substrate would crack in less than about 100 hours, severing the metallic resistive elements and rendering the resistor inoperative. It was also found that at lower temperatures of greater than about 600° C., the solder used to connect the metallic resistor terminals to the substrate would slowly evaporate and be deposited on the inner surface of the outer lamp envelope, reducing its transmittance, and lowering the luminous efficacy of the lamp. It was found that solder evaporation could weaken the terminals to such an extent that the terminals broke off the substrate during lamp operation from shock or vibration.

In another embodiment of the invention, the substrate is selected to have a surface emissivity of greater than about 0.5, and preferably greater than about 0.9. The substrate itself may consist of a material with this emissivity or be coated with a coating have such an emissivity. The conventional white alumina substrate according to the prior art was found to have an emissivity of about 0.5. The advantage of using a substrate of higher emissivity than is conventionally employed is based on the recognition that in a vacuum environment, which is frequently employed within the outer envelope of an HID lamp, convection cooling is not possible. As used herein, a vacuum environment includes an evacuated space with a gas pressure of less than about $10^{-2}$ Torr. Conduction of heat way from the substrate such as to the lamp frame, is also small. Therefore, radiation is the primary mechanism for heat dissipation. While increasing the surface area of the resistor will increase radiation cooling, this is not an attractive alternative because of the space constraints previously mentioned. Using a substrate with higher emissivity permits of the reduction of resistor temperature without increasing substrate size, to prevent cracking of the substrate over life. In addition to a high emissivity, the substrate and/or coating must also have a low vapor pressure so as not to degrade the vacuum within the lamp envelope and to minimize evaporation and deposition of the substrate/coating onto the inner surface of the outer envelope.

In yet another embodiment, the solder which connects the terminals to the substrate is covered with a material of low vapor pressure (e.g. a nickel plating), at a thickness which is optimized to prevent evaporation of the solder and its deposition on the inner surface of the lamp envelope. As used herein, a substrate material or a cover of material for the solder which has a "low vapor pressure" is a material which has a vapor pressure of less than about $10^{-15}$ Torr at 600° C.

With the above two measures, the resistor is especially suited for operation in a high temperature vacuum environment such as within an HID lamp. The high emissivity substrate improves the radiation cooling of the resistor, keeping its temperature within acceptable limits while keeping its size small enough to be included as a component within an HID lamp. In combination with the low vapor pressure material covering the solder, evaporation of the solder material is avoided so that failure of the resistor terminals is not determinative of lamp life. Evaporation of the solder material and its deposition on the lamp envelope are also minimized such that luminous efficacy is not substantially affected due to blackening of the lamp envelope.

DESCRIPTION OF THE PREFERRED EMBODIMENT

Figure 1A:
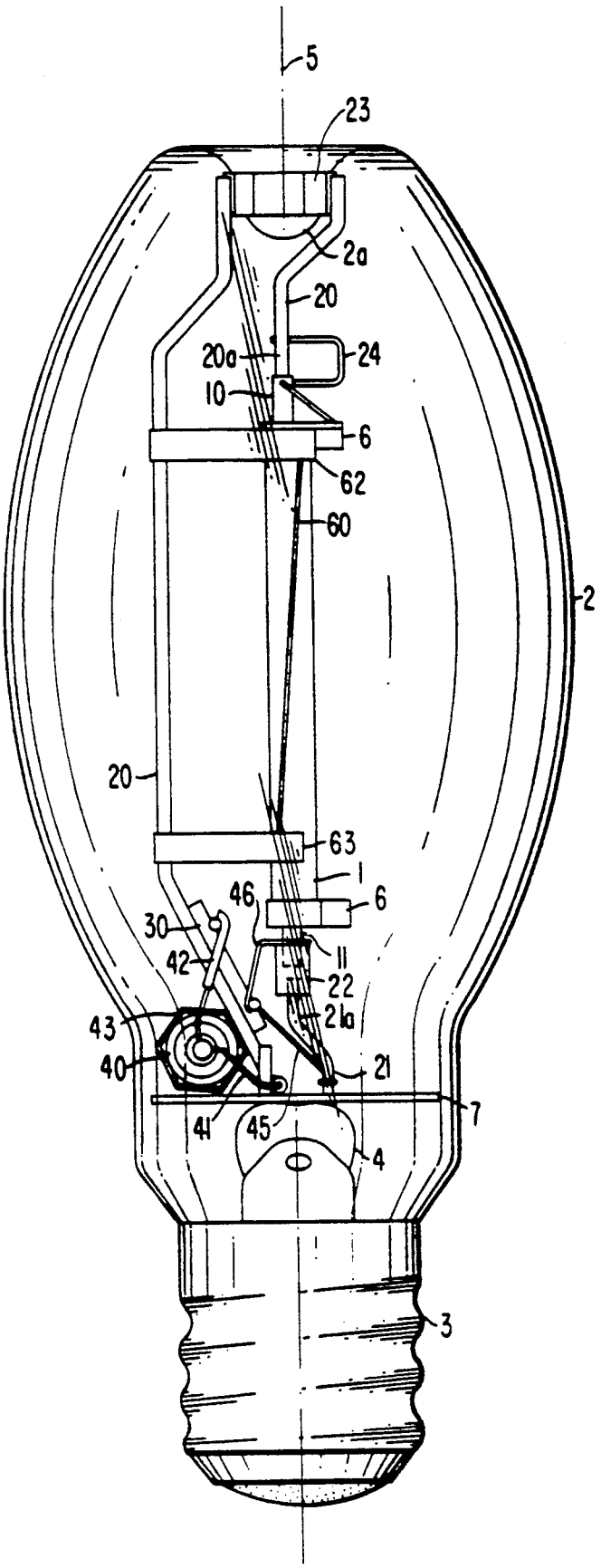
FIG. 1A; 1B illustrates a high pressure sodium vapor discharge lamp according to the invention having an integral thick film resistor with a plurality of integral substrates and resistive elements.

The lamp shown in FIG. 1A is a 150 watt high pressure sodium (HPS) discharge lamp comprised of an elongate discharge vessel, or arc tube, 1 of the unsaturated type disposed within an outer envelope 2 and having a lamp base 3 at one end of the outer envelope 2. The envelope is evacuated, and sealed in a conventional manner by stem 4. A conventional heat deflector 7 protects the glow switch from excessive heating during sealing of the stem to the outer envelope. The discharge vessel has a pair of conductive feed-throughs 10, 11 for applying a voltage to a pair of discharge electrodes within the discharge vessel. Conventional metallic heat shields 6 surround the discharge electrodes adjacent the ends of the arc tube 1.

A quantity of sodium-mercury amalgam is contained within the discharge vessel 1, together with an inert buffer gas such as xenon. The discharge vessel is supported within the lamp envelope by conductive support rods 20 and 21 and an insulative glass or ceramic support element 22. The support element 22 has opposing bores for receiving the ends 21*a* of support rod 21 and feed-through 11, to support the arc tube and electrically insulate the feed-through 11 from conductive support 21.

Figure 1B:
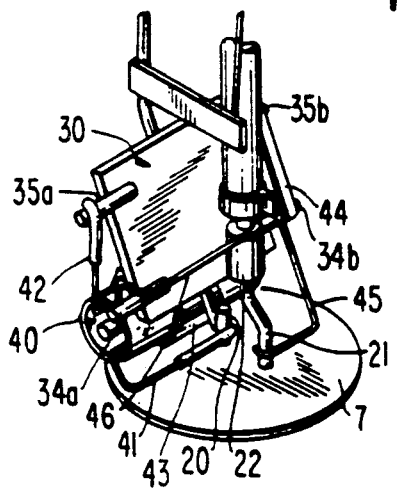

An integral ceramic thick-film resistor 30 is secured between the conductive support rods adjacent the stem and has a first resistive element included in a starting circuit for the discharge vessel and a second resistive element connected in series with the discharge vessel 1. The thick film resistor has 3 ceramic substrate layers 31*a*, 31*b*, and 31*c* of alumina. As shown schematically in FIG. 2, a first resistive element 32 consisting of a conventional deposited tungsten thick film pattern is disposed on the substrate layer 31*b* and a second resistive element 33 also of a conventional tungsten thick film is disposed on substrate layer 31*c*. The first substrate layer 31*a* protects the first resistive element. Resistor terminals 34*a*, 34*b* on substrate 31*a* are connected to the second resistive element 33 and terminals 35*a*, 35*b* are connected to the first resistive element 32. Alternatively, the first and second resistive elements may be deposited on opposite sides of substrate 31*b*, the resistive elements being protected by outer layers 31*a*, 31*c* or by a protective coating applied over the resistive elements. The metallic deposition patterns themselves are conventional and the number of patterns for any given resistance value which may be needed in an HID lamp are numerous. The resistor 30 is secured between the conductive rods by support-lead 45 welded to terminal 34*b* of the resistor and conductor 21 (FIG. 1B).

A starting circuit for starting the discharge vessel consists of a conventional glow starter switch 40, having a pair of bimetallic electrodes therein, in series with the first resistive element 32 and a bimetal switch 44 welded to terminal 34*b* and normally closed against terminal 35*b*. The glow starter 40 is supported by a glow starter holder 43 welded to the conductive support 20. The starting circuit defines a first conductive path in parallel with the discharge vessel 1. The starting circuit consists of a first lead 41 of the glow starter connected to the conductive support rod 20, the glow starter, a second glow starter lead 42 connected to resistor terminal 35*a*, the first resistive element 32, the resistor terminal 35*b*, bimetal switch 44, terminal 34*b*, and support-lead 45 connected to conductive support 21.

A second conductive path extends from the conductive support rod 21, through support-lead 45 to terminal 34*b* of the second resistive element, through the second resistive element 33, the other terminal 34*a*, lead 46, and through niobium feed through 11 through the discharge vessel 1, through niobium feed through 10, connector 24 and conductive rod 20.

The lamp also has a starting aid for inducing ionization throughout the discharge vessel within the limits of the high voltage pulse of the starting circuit. The starting aid consists of conventional antenna 60 and bimetal elements 62 and 63 which are welded to the support rod 20. In the inoperative condition of the lamp, the bimetal elements 62, 63 hold the starting antenna against the wall of the discharge vessel.

The functioning of the starting aid and the starting circuit during ignition of the lamp are as follows. When connected to an inductive stabilization ballast of the constant wattage or reactor type, and the AC supply current is effected, a glow discharge will first be produced in the glow starter 40, which heats the bimetallic electrodes within such that the glow starter electrodes touch and extinguish the glow discharge. A current of high intensity will then flow through the ballast. During this time, the first resistive element 32 limits the current through the glow starter and heats the substrate and the second resistive element 33. Upon cooling, the glow starter electrodes will separate, interrupting the current through the ballast, and causing a high voltage peak across the discharge electrodes of the discharge vessel 1. Simultaneously, a high voltage potential will also be applied between the starting antenna 60, via the bimetal elements 62, 63 and conductor 20, and the discharge electrode adjacent the feed-through 11. This causes substantial ionization of the buffer gas throughout the discharge vessel, and starting of the discharge due to the large potential difference between the discharge electrodes. At this time, lamp current flows through the second conductive path described above, including the second resistive element which has been heated by the first resistive element prior to ignition of the discharge arc.

After ignition of the discharge arc, the voltage between the discharge electrodes will be below the closure voltage value of the glow starter electrodes, the glow starter will remain extinguished, and current will not flow through the glow starter or starting resistor. After several minutes, heat from the discharge vessel 1 causes the bimetal switch 44 to open and electrically disconnect the glow starter 40 and the first resistive element 32 from conductor 21 so that the glow starter and first resistive element are no longer connected electrically in parallel with the discharge vessel. Heat from the discharge vessel also causes the bimetals 62 and 63 to move the starting antenna 60 away from the discharge vessel.

In the event of unsuccessful ignition of the discharge vessel, heat from the resistor substrate causes the bimetal switch 44 to open before the resistor exceeds a temperature of approximately 600° C., typically within a minute of energization of the lamp.

In the lamp shown in FIG. 1, the value of the first resistive element is 165 ohms at 23° C. and dissipates approximately 200 watts during operation of the starting circuit. If the discharge arc is successfully ignited, the first resistive element is operative for only approximately 15 to 20 seconds after initial application of the electric potential to the lamp. The electrical requirement for the series-connected resistor element is 6Ω at a lamp current of 1.4 A. This value was found to prevent lamp instabilities from occurring (150 W HPS retrofit lamp operating on 175 W mercury CWA ballast).

For the first prototype, a thick film tungsten track was sandwiched between a conventional "white" alumina substrate (composition by weight: $Al_2O_3$−91%; $S_iO_2$−5%; MgO−2%; CaO−1%; other−1%). The alumina substrate measured 23 mm square×2.5 mm thick. The tungsten track dimensions for the series connected second resistive element were length 133.6 mm, width 0.8 mm and thickness 4 μm which gave a resistance of about 2Ω at 23° C. The terminals 34*a,b*; 35*a,b* were made of Kovar® an iron-nickel-cobalt alloy, and brazed to the substrate 31*a* with a conventional solder (72% silver, 28% copper). The solder was further covered by a nickel plating of about 1 μm thickness.

Subsequent investigations revealed significant problems if the resistance differed greatly from the required 6Ω for a 150 W HPS lamp. If lower, then the series resistive element does not always guard against lamp instabilities (flicker) under worst case field conditions. On the other hand, if the resistance value is higher it lowers lamp luminous efficacy, since more power is dissipated as heat in the resistor. It may also lead to early resistor failure. Each additional ohm represents nearly a 2 W increase in the resistor power (for a current of 1.4 A) which is about a 16% increase in the power the resistor has to dissipate. A certain margin in the power dissipation capability of the resistor is required in order to accommodate a higher lamp current either due to an increase in the supply voltage and/or the slump in lamp voltage that unsaturated HPS lamps experience due to sodium loss over lamp life. Taking the above into consideration, it has been determined that the resistor should be capable of operating at an upper current level of 1.9 A, even though the nominal lamp current is only 1.5 A. At 1.9 A, the resistor power dissipation is about 28 W, i.e., nearly double the dissipation at the lower, nominal current level. This overload condition imposes stringent requirements on resistor construction.

Figure 3:
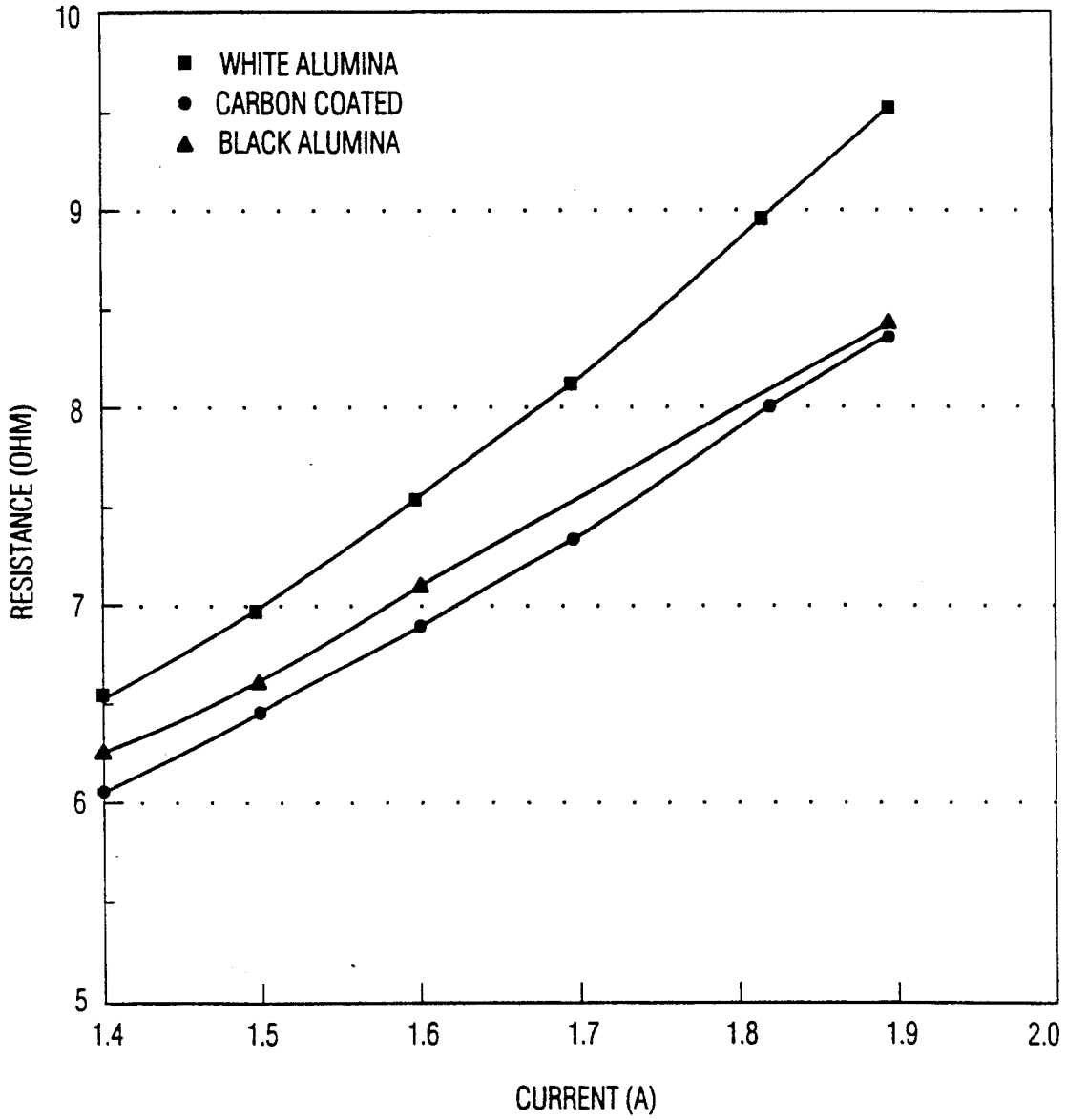
FIG. 3 is a graph of resistance as a function of current for a resistive element of a thick film tungsten resistor in a vacuum.

The passage of current through the resistor generates heat. The resistance value is a function of the temperature and indirectly of the current. FIG. 3 gives the resistance measured as a function of current in the range 1.4 to 1.9 A for three types of resistors. These measurements are averages of 5 resistors connected in series and mounted in a vacuum bulb. The temperature on the resistor surface may be calculated from the formula:

$$R_1 = R_0\,[1 + 0.0052\,(T_1 - T_0)]$$

where $R_1$ = resistance at temperature $T_1$ $R_0$ = resistance at $T_0$ (23° C.) = 2.1Ω for this resistor 0.0052 = temperature coefficient of resistance for the described resistor The resistor characteristics for the resistors with conventional "white" alumina substrates were not acceptable on three counts: (i) the resistance value at 1.4 A was about 0.5Ω higher than desired as shown in FIG. 3, and more seriously, (ii) at higher currents, i.e. over 1.5 A, evaporation of the solder was found to occur which reduced lamp luminous output by blackening the outer lamp envelope and which also weakened the lead attachment leading to early resistor failure, and (iii) at 1.9 A, the resistor could not handle the power dissipation and failed by cracking of the substrate in less than 100 hours.

It was discovered that all of the above problems could be alleviated by reducing the resistor temperature sufficiently over the expected current range of 1.4 A to 1.9 A and by covering the silver-copper solder by a suitable material. The resistor temperature may be lowered by having a lower cold resistance and/or by increasing the surface area and/or surface emissivity (since radiation is substantially the only form of heat dissipation). The conventional "white" alumina surface is estimated to have an emissivity of about 0.5 for the resistor operating conditions. When resistors (from the same batch) were coated with graphite (emissivity > 0.9), a substantial drop in the resistance is observed (FIG. 3), confirming that radiation is indeed the dominant mechanism for heat dissipation. There is a temperature difference of over about 100° C. between the coated and uncoated resistors at a current of 1.9 A.

While coating of the resistor surface with graphite has been shown to be effective in reducing the resistor temperature and ohmic value, it is not the most advantageous for manufacturing. A preferable method is to alter the resistor substrate composition to achieve a high emissivity. This is obtained with "black" alumina having a composition by weight of ($Al_2O_3$ − 91%; $SiO_2$ − 5%; MgO − 2%; CaO − 1%; $TiO_2$ − 1%; others 1%). Though dark purple in color, it is usually referred to as "black" alumina. The resistance-current characteristics for this resistor is also shown in FIG. 3 and may be compared with the curves for the uncoated or "white" alumina resistor and the graphite coated resistor. It should be noted that tungsten track and substrate surface dimensions were nominally the same for all resistors shown. A large reduction in the resistor value at each of the measured currents is seen for the "black" alumina substrate.

For the lamp current range of interest, dissipated power and (calculated) temperatures are given in the table below for the three resistor designs. The "black" alumina resistor values are very close to those of the graphite coated resistors, indicating that its surface emissivity approaches that of the latter and that it is a feasible approach to reduce resistor temperature.

TABLE

Comparison of three resistor designs

| | "White" alumina | | Carbon coated | | "Black" alumina | |
|---|---|---|---|---|---|---|
| Current (A) | Power (W) | Temp. (°C.) | Power (W) | Temp. (°C.) | Power (W) | Temp. (°C.) |
| 1.4 | 12.8 | 430 | 11.9 | 386 | 12.3 | 405 |
| 1.5 | 15.7 | 471 | 14.6 | 424 | 14.9 | 438 |
| 1.6 | 19.3 | 522 | 17.7 | 463 | 18.2 | 480 |
| 1.7 | 23.4 | 573 | 21.2 | 503 | — | — |
| 1.825 | 29.9 | 652 | 26.7 | 562 | — | — |
| 1.9 | 34.3 | 701 | 30.1 | 595 | 30.4 | 601 |

The reduction in temperature due to higher surface emissivity eliminated resistor failures due to substrate cracking at 1.9 A operation. Both the graphite coated resistors and the "black" alumina resistors were operated at 1.9 A in vacuum up to 3000 hours without any failures. By contrast, the resistors with "white" alumina substrates failed by cracking in less than 100 hours.

The solder evaporation problem was addressed by nickel plating the solder area. Metallic nickel has a low vapor pressure of about $10^{-15}$ Torr at 600° C. which does not degrade the vacuum within the outer envelope. In an experiment, nickel plating was applied in thicknesses of 1, 6 and 13 μm to the silver soldered areas. In vacuum tests, resistors with nickel plating showed evidence of solder evaporation within 700 hours, while in resistors with the thicker plating, no evaporation was observed after several thousand hours. In lamps, however, blistering of the nickel plating was seen for the 13 μm thicknesses after a few thousand hours. A plating thickness of between about 4 and 8 μm, and preferably about 6 μm, was considered to be optimum. With a plating thickness in this range, both solder evaporation and blistering of the plating are substantially avoided over lamp life.

In order to provide a further margin of safety, the cold resistance was reduced to 1.9Ω, nominal. With these improvements, spreads in lamp operating conditions and resistor tolerances can be handled without resistor failure at the highest expected lamp current of 1.9 A out to an HPS lamp life of about 24,000 hours.

Figure 2:
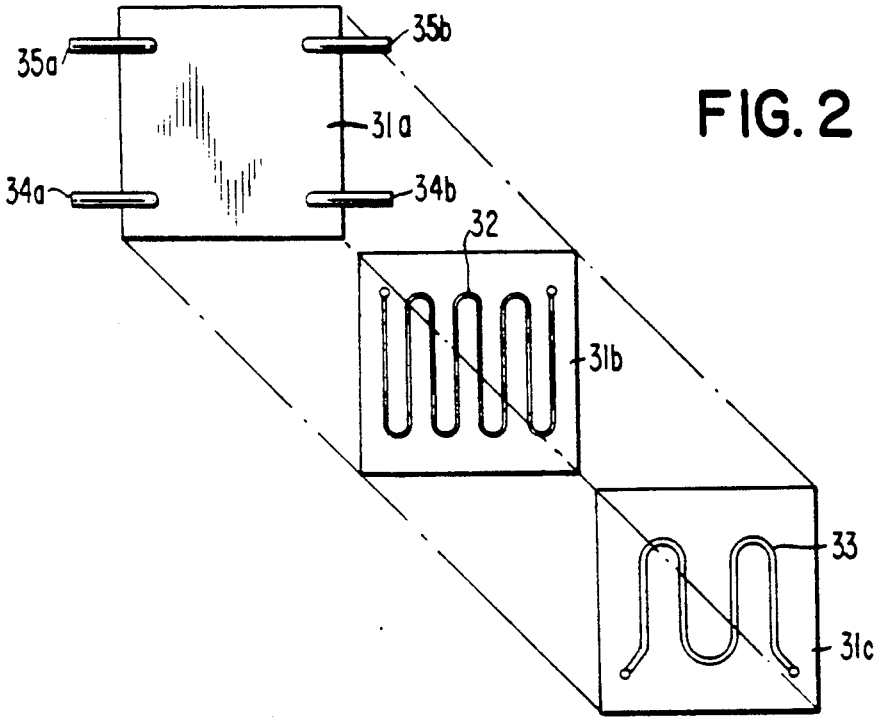
FIG. 2 shows an exploded view of the thick film resistor.

The design of a practical integral resistor as shown in FIG. 2 embodying these concepts is summarized below. The resistor consists of two thick-film resistor elements, a high valued (165 ohm) starting element for short duty and a low valued (1.9 ohm) resistor for continuous operation. High emissivity "black" alumina substrates and a thick nickel plating (6 μm) to shield the silver-copper solder were employed. The substrate had dimensions 23 mm square by 2.5 mm thick. This resistor construction was found to be capable of extremely high continuous power dissipation density in vacuum without damage, nearly 2.3 W/sq.cm (≅30 W≈resistor surface area of 12.9 $cm^2$).

The integral combination resistor has width and height dimensions which are no larger than the dimensions of a similar thick film resistor having only a 165Ω resistive element for a starting circuit. The incorporation of a series flicker elimination resistor into the same sized component effectively eliminates the mounting of an additional resistor component for the series flicker elimination element and facilitates a simpler mount construction.

In addition to the mounting and reliability advantage of providing the integral ceramic resistor in the lamp shown in FIG. 1, the provision of the high power dissipating starting resistive element 32 on an integral substrate with the lower power dissipating flicker elimination resistive element 33 has the advantage that during starting the heat from the first resistive element heats the substrate so that the resistance of the lower resistive element 33 increases more quickly to its desired operating value. This has the operational advantage that the reignition arc voltage of the arc tube was reduced, and flicker prevented more quickly than with a separate resistor component.

The combination of the lower wattage flicker elimination resistor with the high wattage starting resistor on an integral substrate also has the advantage that the lower wattage resistor 33 is substantially pre-heated by the first resistive element prior to flow of the lamp current, and is thus subject to reduced thermal shock.

While there has been shown to be what are presently considered to be the preferred embodiments of the invention, it will be apparent to those of ordinary skill in the art that modifications can be made to the lamps and resistor without departing from the scope of the invention as defined by the appended claims.

What is claimed is:

1. A high pressure discharge lamp having an outer lamp envelope, a discharge vessel disposed within said lamp envelope and energizable for emitting light, and multiple resistor means within said envelope, characterized in that:

an integral thick film resistor comprises a substrate and a plurality of metallic resistive elements disposed on said substrate which comprise said plurality of said resistor means, said substrate consists essentially of a material having an emissivity of greater than about 0.9.

2. A high pressure discharge lamp according to claim 1, wherein said resistor has an outer surface with a surface emissivity of greater than about 6.5.

3. A high pressure discharge lamp according to claim 1, wherein said substrate material consists essentially of 91% by weight of $Al_2O_3$, 5% $SiO_2$, 2% MgO, 1% CaO and 1% $T_iO_2$.

4. A high pressure discharge lamp according to claim 1, wherein said substrate comprises three substrate layers, a first of said resistive elements being disposed between a first and second of said layers and a second of said resistive elements being disposed between the second and a third of said layers, and the first and third substrate layers each consist essentially of a material having an emissivity of greater than about 0.9.

5. A high pressure discharge lamp according to claim 4, wherein said lamp further comprises a starting circuit for igniting said discharge vessel and which includes said first resistive element, and said second resistive element is connected electrically in series with said discharge vessel during lamp operation.

6. A high pressure discharge lamp according to claim 5, further comprising disconnecting means for electrically disconnecting said first resistive element for preventing said integral thick film resistor from exceeding a predetermined temperature.

7. A high pressure discharge lamp according to claim 6, wherein said disconnecting means comprises a bimetal switch mounted on said integral thick film resistor and effective for disconnecting said first resistive element in response to heat from said integral thick film resistor in the event of unsuccessful ignition of said discharge vessel and in response to heat from said discharge vessel in the event of successful ignition of said discharge vessel.

8. A high pressure discharge lamp according to claim 7, wherein said second resistive element is effective for preventing flicker of light emitted from said discharge vessel when said lamp is operated on a constant wattage type ballast.

9. A high pressure discharge lamp according to claim 1, wherein said resistor comprises metallic terminals corresponding to each resistive element, and connecting means for mechanically and electrically connecting said terminals to said substrate and said resistive elements substantially without causing deposition of material on said lamp envelope and without degrading said vacuum over lamp life.

10. A high pressure discharge lamp according to claim 9, wherein said connecting means comprises a metallic solder and a cover of material on said solder for preventing evaporation of said solder and deposition of said solder on said lamp envelope.

11. A high pressure discharge lamp according to claim 10, wherein said solder consists essentially of about 72% silver and 28% copper and said cover of material on said solder is a nickel plating with a thickness of between about 4 and 8 μm.

12. An unsaturated high pressure sodium discharge lamp for operation on a constant wattage type ballast, said lamp comprising:

an evacuated outer lamp envelope;

a discharge vessel within said outer envelope including a pair of discharge electrodes between which a discharge is maintained during lamp operation, said discharge vessel having a filling comprising mercury, sodium, and an inert gas, said mercury and sodium being completely vaporized during lamp operation, said discharge vessel having a nominal rated life, and an operating current varying between a lower and an upper limit during lamp operation over said rated life when operated on a constant wattage type ballast;

means comprising a lamp frame for mechanically supporting said discharge vessel within said lamp envelope and electrically connecting said discharge vessel to a source of electric potential outside of said lamp envelope;

a starting circuit within said lamp envelope for inducing ionization within said discharge vessel during lamp starting to initiate an arc discharge between said discharge electrodes, said starting circuit comprising a first resistor means connected electrically in parallel with said discharge vessel during lamp starting;

a second resistor means connected electrically in series with said discharge vessel for preventing flicker of the discharge arc when said lamp is operated on a constant wattage type ballast; and an integral thick film resistor including a substrate and first and second tungsten thick film resistor elements deposited on said substrate which comprise said first and second resistor means, respectively, metallic resistor terminals connected to a corresponding tungsten resistor element, a metallic solder securing each of said terminals to said substrate and a cover of material of low vapor pressure covering said solder, said substrate having a surface emissivity of greater than about 0.9, said substrate having a surface area and said cover of material on said solder having a thickness selected such that during operation of said first and second resistive elements with said discharge vessel operating current within said upper and lower limits, said substrate remains within a temperature such that evaporation of said solder is substantially eliminated and substantially does not darken the inner surface of said lamp envelope over said nominal rated life, and such that said substrate has a temperature such that said substrate does not crack over said nominal rated life.

13. An unsaturated high pressure sodium discharge lamp according to claim 12, wherein said lamp has a nominal power rating of about 150 Watts, said first resistive element has a nominal rating of about 165 ohms at 23° C. and said second resistive element has a nominal rating of between about 1.9 and 2.1 ohms at 23° C., said substrate having a largest dimension of less than about 25 mm, said integral resistor having a power density of about 2.3 $W/cm^2$ and a temperature of less than about 600° C. during operation of said lamp after ignition of said discharge vessel.

14. A high pressure discharge lamp according to claim 12, wherein said solder consists essentially of about 72% silver and 28% copper and said covering of material consists of a nickel plating with a thickness of between about 4 and 8 μm.

15. A high pressure discharge lamp according to claim 12, wherein said substrate material consists essentially of 91% by weight of $Al_2O_3$, 5% $SiO_2$, 2% MgO, 1% CaO and 1% $T_iO_2$.

16. A high pressure discharge lamp having an evacuated outer lamp envelope with an inner surface, a discharge vessel disposed within said lamp envelope and energizable for emitting light, and multiple resistor means within said envelope, characterized in that:

an integral thick film resistor comprises a substrate, a plurality of metallic resistive elements disposed on said substrate which comprises said plurality of said resistor means, metallic terminals corresponding to each resistive element, and connecting means for mechanically and electrically connecting said terminals to said substrate and said resistive elements substantially without causing deposition of material on said inner surface of said lamp envelope and without degrading said vacuum over lamp life.

17. A high pressure discharge lamp according to claim 16, wherein said connecting means comprises a metallic solder and a cover of material on said solder for preventing evaporation of said solder and deposition of said solder on said inner surface of said lamp envelope.

18. A high pressure discharge lamp according to claim 17, wherein said solder consists essentially of about 72% silver and about 28% copper and said cover of material on said solder is a nickel plating with a thickness of between about 4 and 8 μm.

19. A high pressure discharge lamp according to claim 18, wherein said resistor has a surface emissivity of greater than about 0.9.

20. A high pressure discharge lamp according to claim 19, wherein said substrate includes a coating on its outer surface having an emissivity of greater than about 0.9.

21. A high pressure discharge lamp according to claim 20, wherein said coating is graphite.

22. A high pressure discharge lamp according to claim 19, wherein said substrate consists essentially of a material having an emissivity of greater than about 0.9.

23. A high pressure discharge lamp according to claim 16, wherein said resistor has a surface emissivity of greater than about 0.9.

24. A high pressure discharge lamp according to claim 23, wherein said substrate includes a coating on its outer surface having an emissivity of greater than about 0.9.

25. A high pressure discharge lamp according to claim 24, wherein said coating is graphite.

26. A high pressure discharge lamp having an evacuated outer lamp envelope, a discharge vessel disposed within said lamp envelope and energizable for emitting light, and a resistor within said envelope, characterized in that:

said resistor is a thick film resistor comprising a substrate and a thick film tungsten resistive element disposed on said substrate;

said substrate has a surface emissivity of greater than about 0.9 and consists essentially of 91% by weight of $Al_2O_3$, 5% $SiO_2$, 2% MgO, 1% CaO and 1% $T_iO_2$, metallic connection terminals are electrically connected to said resistive element and mechanically fixed to said substrate by a metallic solder, a coating of nickel with a thickness of between about 4 and 6 μm covers said solder, and the surface area of said substrate and the ohmic resistance of said resistive element are selected such that said resistor has a temperature during lamp operation of less than about 600° C.

27. A thick film resistor for operation in an evacuated environment, said resistor comprising:

a substrate and a thick film tungsten resistive element disposed on said substrate, said substrate having a surface emissivity of greater than about 0.9 and consisting essentially of 91% by weight of $Al_2O_3$, 5% $SiO_2$, 2% MgO, 1% CaO and 1% $T_iO_2$, metallic connection terminals electrically connected to said resistive element and mechanically fixed to said substrate by a metallic solder, and a coating of nickel with a thickness of between about 4 and 6 μm covering said solder, the surface area of said substrate and the ohmic resistance of said resistive element being selected such that said resistor has a temperature during operation of less than about 600° C. when operated in a vacuum of less than $10^{-2}$ Torr.

* * * * *